US011488561B2

(12) United States Patent
Xie et al.

(10) Patent No.: US 11,488,561 B2
(45) Date of Patent: Nov. 1, 2022

(54) DEMULTIPLEXER CIRCUIT, ARRAY SUBSTRATE, DISPLAY PANEL AND DEVICE, AND DRIVING METHOD

(71) Applicant: Xiamen Tianma Micro-Electronics Co., Ltd., Xiamen (CN)

(72) Inventors: Yahui Xie, Xiamen (CN); Guochang Lai, Xiamen (CN); Zhijie Wang, Xiamen (CN); Jian Liu, Xiamen (CN)

(73) Assignee: XIAMEN TIANMA MICRO-ELECTRONICS CO., LTD., Xiamen (CN)

( * ) Notice: Subject to any disclaimer, the term of this patent is extended or adjusted under 35 U.S.C. 154(b) by 127 days.

(21) Appl. No.: 17/006,665

(22) Filed: Aug. 28, 2020

(65) Prior Publication Data

US 2020/0394979 A1 Dec. 17, 2020

(30) Foreign Application Priority Data

Jun. 30, 2020 (CN) ..... 202010620855.X

(51) Int. Cl.
*G09G 3/36* (2006.01)

(52) U.S. Cl.
CPC ... *G09G 3/3688* (2013.01); *G09G 2310/0297* (2013.01)

(58) Field of Classification Search
CPC ..... G09G 3/3688; G09G 2310/0297
USPC ..... 345/55
See application file for complete search history.

(56) References Cited

U.S. PATENT DOCUMENTS

2020/0381458 A1* 12/2020 Yang ..... H01L 27/3218

FOREIGN PATENT DOCUMENTS

| | | |
|---|---|---|
| CN | 206194295 U | 5/2017 |
| CN | 106935223 A | 7/2017 |
| CN | 110060621 A | 7/2019 |

* cited by examiner

*Primary Examiner* — Amare Mengistu
*Assistant Examiner* — Gloryvid Figueroa-Gibson
(74) *Attorney, Agent, or Firm* — Alston & Bird LLP

(57) ABSTRACT

Provided are a demultiplexer circuit, an array substrate, a display panel and device, and a driving method. The demultiplexer circuit includes multiple demultiplexers, each demultiplexer includes at least two switching transistor groups, and each switching transistor group includes at least two switching transistors. Sources of the at least two switching transistors in a same switching transistor group are electrically connected to each other, drains of the at least two switching transistors in the same switching transistor group are electrically connected to each other. Input ends of the at least two switching transistor groups in a same demultiplexer are electrically connected to each other. In the same switching transistor group, the common source is electrically connected to the input end, the common drain is electrically connected to the output end, and at least two control ends are electrically connected to gates of the switching transistors in a one-to-one correspondence.

15 Claims, 12 Drawing Sheets

DEMULTIPLEXER CIRCUIT, ARRAY SUBSTRATE, DISPLAY PANEL AND DEVICE, AND DRIVING METHOD

CROSS-REFERENCE TO RELATED APPLICATIONS

This application claims priority to Chinese patent application No. CN202010620855.X filed with CNIPA on Jun. 30, 2020, the disclosure of which is incorporated herein by reference in its entirety.

TECHNICAL FIELD

Embodiments of the present disclosure relate to the field of display technologies and, in particular, to a demultiplexer circuit, an array substrate, a display panel and device, and a driving method.

BACKGROUND

Thin film transistor (TFT) flat panel displays are mainstream display technologies nowadays. Thanks to the rapid development of TFT technology, the TFT flat panel displays are developing towards the direction of large size and high resolution.

A TFT display panel includes a TFT pixel array, a data driving circuit, data lines, a scan driving circuit and scan lines. The TFT pixel array typically is composed of M by N two-dimensional M*N TFT subpixel units. M scan lines are used to provide gate control signals to TFTs of the TFT subpixel units. N data lines are used to provide source input signals to the TFTs of the TFT subpixel units. To reduce the number of data lines in the non-display region and save the drive module of the source driving circuit, a demultiplexer is usually applied to the TFT display panel. The demultiplexer is used to divide one input into a plurality of outputs, an input end of the demultiplexer is connected to the driver chip, and output ends of the demultiplexer are connected to a plurality of data lines. At this time, multiple columns of subpixel units may provide data signals at different times through one demultiplexer, thereby meeting the demand of data driving display panel.

However, existing demultiplexers in a display panel also include thin film transistors, and the metal electrodes and the semiconductor layers of the thin film transistors tend to generate parasitic capacitances. When the array substrate of the display panel is manufactured, parameters of sizes of the thin film transistors in the demultiplexer are fixed, that is, the parasitic capacitances of the thin film transistors are fixed, resulting in the increase of power consumption. As a result, under different driving signals, the thin film transistors produce additional fixed power loss, which is detrimental to the power consumption of the display device.

SUMMARY

The present disclosure provides a demultiplexer circuit, an array substrate, a display panel and device, and a driving method to adapt to scale parameters of transistors in the demultiplexer circuit adjusted by driving signals and decrease the parasitic capacitance in the thin film transistors, thereby achieving the purpose of reducing power consumption.

In an embodiment, the present disclosure provides a demultiplexer circuit. The demultiplexer circuit includes multiple demultiplexers each including at least two switching transistor groups.

Each switching transistor group includes at least two switching transistors, sources of the at least two switching transistors in a same switching transistor group are electrically connected to each other to form a common source, and drains of the at least two switching transistors in the same switching transistor group are electrically connected to each other to form a common drain.

Each switching transistor group includes one input end, one output end and at least two control ends, and input ends of the at least two switching transistor groups in a same demultiplexer are electrically connected to each other. In the same switching transistor group, the common source is electrically connected to the input end, the common drain is electrically connected to the output end, and the at least two control ends are electrically connected to gates of the at least two switching transistors in a one-to-one correspondence.

In an embodiment, the present disclosure further provides an array substrate, including a substrate and the demultiplexer circuit of the first aspect disposed on the substrate.

The substrate includes a display region and a non-display region adjacent to the display region, and the demultiplexer circuit is located in the non-display region.

In an embodiment, the present disclosure further provides a display panel, including the array substrate of the second aspect, and the display panel further includes multiple data lines and multiple subpixel units arranged in an array.

In the demultiplexer circuit on the array substrate, each switching transistor group in each demultiplexer is connected to a respective one of the multiple data lines, and each of the multiple data lines is connected to a plurality of subpixel units in a same column.

In an embodiment, the present disclosure further provides a method of driving a display panel applied to the display panel of the third aspect, and the driving method includes steps described below.

For a same demultiplexer of the multiple demultiplexers, in a first stage, a data voltage signal having a first polarity is provided to input ends of the at least two switching transistor groups in the demultiplexer, and a control-on signal is provided to all control ends of the at least two switching transistor groups in the demultiplexer; and for the same demultiplexer, in a second stage, a data voltage signal having a second polarity is provided to the input ends of the at least two switching transistor groups in the demultiplexer, and a control-off signal is provided to at least one control end of the at least two switching transistor groups in the demultiplexer and the control-on signal to the other control ends of the at least two switching transistor groups in the demultiplexer.

A polarity of the data voltage signal having the first polarity is opposite to a polarity of the data voltage signal having the second polarity; and a voltage difference between the data voltage signal having the first polarity and the control-on signal is less than a data voltage signal between the data voltage signal having the second polarity and the control-on signal.

In an embodiment, the present disclosure further provides a display device, including the display panel of the third aspect.

In the demultiplexer circuit, array substrate, display panel and device, and driving method according to the embodiments of the present disclosure, the multiple demultiplexers are disposed in the demultiplexer circuit, each demultiplexer includes at least two switching transistor groups, and each switching transistor group includes at least two switching transistors. The sources of the at least two switching transistors in the same switching transistor group are electrically connected to each other to form a common source. The drains of the at least two switching transistors in the same switching transistor group are electrically connected to each other to form a common drain. Moreover, each switching transistor group includes one input end, one output end and at least two control ends. The input ends of the at least two switching transistor groups in the same demultiplexer are electrically connected to each other. In the same switching transistor group, the common source is electrically connected to the input end, the common drain is electrically connected to the output end, and the at least two control ends are electrically connected to the gates of the at least two switching transistors in a one-to-one correspondence. In this manner, the number of turned-on switching transistors in each switching transistor group can be controlled, and the channel width-to-length ratio and parasitic capacitance of each switching transistor group can be changed. The embodiments of the present disclosure can reduce high power consumption caused by the fixed parasitic capacitance of an existing demultiplexer, and on the premise that the conduction degree of the transistor meets the requirements, the channel width-to-length ratio of each switching transistor group is changed, so as to adapt to the size of the parasitic capacitance adjusted by driving signals, thereby reducing the power consumption of the demultiplexer circuit.

DETAILED DESCRIPTION

Figure 1:
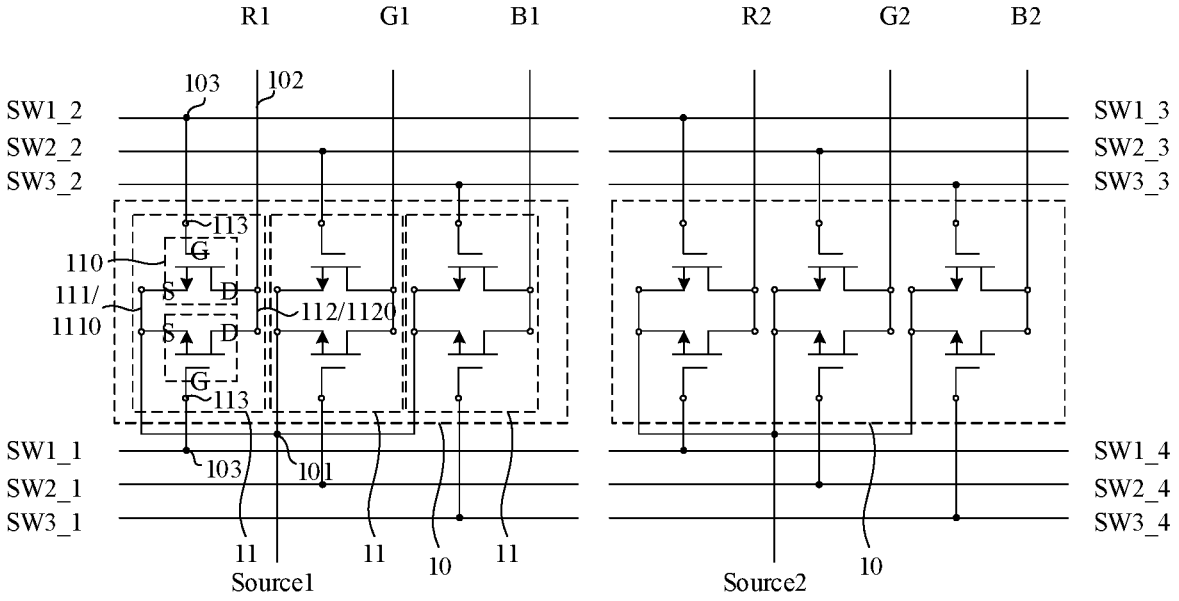
FIG. 1 is a schematic diagram illustrating a structure of a demultiplexer circuit according to an embodiment of the present disclosure.

The present disclosure will be further described in detail in conjunction with drawings and embodiments. It is to be understood that the embodiments described herein are intended to illustrate and not to limit the present disclosure. It is to be noted that to facilitate description, only part, not all, of structures related to the present disclosure are illustrated in the drawings.

FIG. 1 is a schematic diagram illustrating a structure of a demultiplexer circuit according to an embodiment of the present disclosure. Referring to FIG. 1, the demultiplexer circuit includes multiple demultiplexers 10. Each demultiplexer 10 includes at least two switching transistor groups 11, each switching transistor group 11 includes at least two switching transistors 110, sources 111 of the at least two switching transistors 110 in a same switching transistor group 11 are electrically connected to each other to form a common source 1110, and drains 112 of the at least two switching transistors 110 in the same switching transistor group 11 are electrically connected to each other to form a common drain 1120.

Each switching transistor group 11 includes one input end 101, one output end 102 and at least two control ends 103, input ends 101 of the at least two switching transistor groups 11 in a same demultiplexer 10 are electrically connected to each other. In the same switching transistor group 11, the common source 1110 is electrically connected to the input end 101, the common drain 1120 is electrically connected to the output end 102, and the at least two control ends 103 are electrically connected to gates of the at least two switching transistors 113 in a one-to-one correspondence.

The demultiplexer 10 is also called a data selector, which is a circuit that transfers input data to any one of multiple outputs as required. The demultiplexer circuit may realize at least two paths of inputs and multiple paths of switching outputs through the at least two demultiplexers 10 arranged therein. In the demultiplexer circuit according to the embodiments of the present disclosure, each demultiplexer 10 is composed of at least two switching transistor groups 11, as shown in FIG. 1, for example, three switching transistor groups 11 are provided, and each switching transistor group 11 includes at least two switching transistors 110, as shown in FIG. 1 that each switching transistor group 11 includes two switching transistors 110. The structure of the switching transistor group 11 will be introduced by taking the structure of the leftmost switching transistor group 11 as an example. The input end 101 of the switching transistor group 11 is essentially the common source 1110 formed by an electrical connection of the sources 111 of the two switching transistors 110, and the output end 102 of the switching transistor group 11 is essentially the common drain 1120 formed by an electrical connection of the drains 112 of the two switching transistors 110. The gate 113 of the two switching transistors 110 are separated and insulated from each other, so each switching transistor 110 may be controlled to be turned on or off individually. Therefore, this switching transistor group 11 essentially contains control ends 103 with a number corresponding to the number of switching transistors 110. When the switching transistor group 11 includes two switching transistors 110, the switching transistor group 11 includes two control ends 103.

The structure of the demultiplexer 10 will be introduced by taking the structure of the leftmost demultiplexer 10 as an example. First, each demultiplexer 10 may be configured to include at least two switching transistor groups 11. As shown in FIG. 1, for example, three switching transistor groups 11 are configured, the input ends of each switching transistor group 11 are electrically connected to each other, then the three switching transistor groups 11 share one input end 101, and input signals of these three switching transistor groups 11 are consistent and synchronous. The output ends 102 of the three switching transistor groups 11 are separated and insulated, then the three transistor groups 11 constitute the three output ends of the demultiplexer 10. Furthermore, each switching transistor 110 of each switching transistor group 11 in the demultiplexer 10 is individually configured with a gate 113, each switching transistor group 11 includes multiple control ends 103, the demultiplexer 10 includes multiple control ends 103 of the multiple switching transistor groups 11, and the number of control ends of the demultiplexer 10 is equal to the total number of switching transistors 110 therein. As can be seen, the demultiplexer 10 includes one input end, output ends with a number corresponding to the number of switching transistor groups 11, and control ends with a number corresponding to the number of switching transistors 110. When the demultiplexer circuit is in operation, a gate signal and a source signal are respectively provided to the gate 113 and the source 111 of each switching transistor 110 through a driving chip, so the on/off control of each switching transistor 110 may be realized through the voltage difference between the gate and the source. The conduction of each demultiplexer 10 may be individually controlled through the adjustment of a gate-source voltage difference of the corresponding switching transistor. Further, through the adjustment of the timing of the gate-source voltage difference, the multiple demultiplexers 10 may be controlled to be sequentially and chronologically turned on. For each demultiplexer 10, the conduction of a respective switching transistor group 11 therein may also be individually controlled through the adjustment of the gate-source voltage difference of the corresponding switching transistor. Further, through the adjustment of the timing of the gate-source voltage difference, the multiple demultiplexers 11 may be controlled to be turned on sequentially. Moreover, in the process of controlling each switching transistor group 11 to be turned on sequentially, any one or more switching transistors 110 in each switching transistor group 11 may be turned on through the adjustment of the gate-source voltage difference of the respective one or more switching transistors. As shown in FIG. 1, when the leftmost switching transistor group 11 is turned on, that is, any one of the upper switching transistor 110 or the lower switching transistor 110 may be turned on, or two switching transistors 110 may be turned on at the same time.

It is to be noted that, in the embodiments of the present disclosure, size parameters, such as the channel width-to-length ratio, of at least two switching transistors 110 in a same switching transistor group 11 may be configured to be the same or different. It is to be understood that when any two switching transistors 110 in a same switching transistor group 11 are all turned on, the two switching transistors 110 essentially constitute a large switching transistor 110, and the channel width-to-length ratio of this large switching transistor is equal to the sum of the channel width-to-length ratios of the two small switching transistors 110. As is mentioned in the background part, the channel width-length ratio of the transistor represents the parasitic capacitance of the transistor to a certain extent. Apparently, when different switching transistors 110 in a same switching transistor group 11 are controlled to be turned on, that is, to perform a selection of the width-length ratio of the switching transistor group 11, so that the parasitic capacitance in the switching transistor group 11 can be adjusted.

Figure 2:
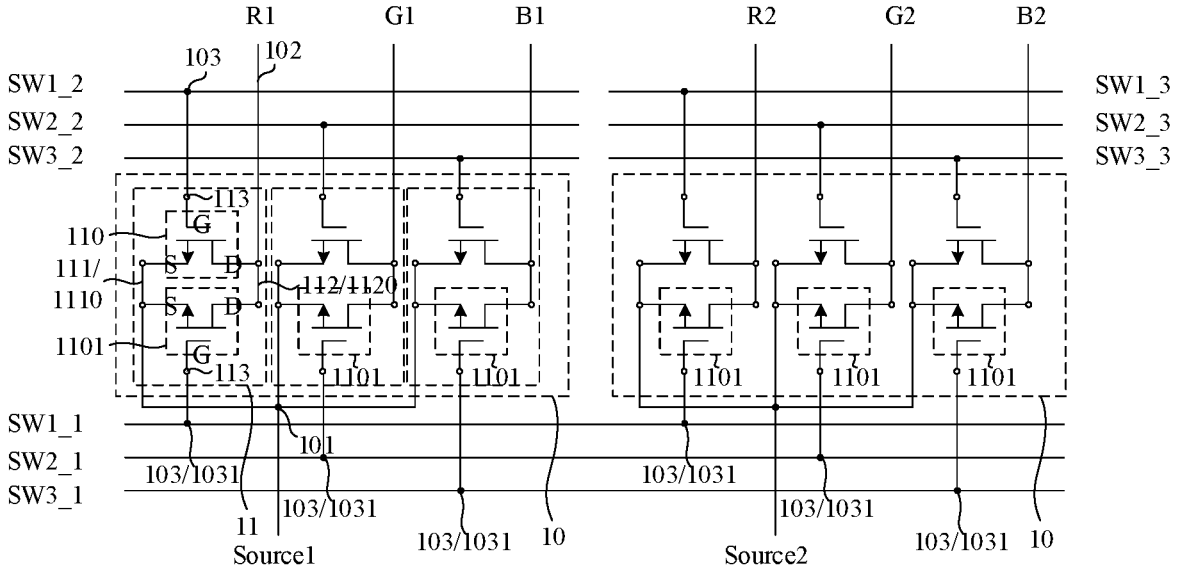
FIG. 2 is a schematic diagram illustrating a structure of another demultiplexer circuit according to an embodiment of the present disclosure.

Taking that the switching transistors shown in FIG. 1 are all NMOS transistors as an example to explain the principle of reducing power consumption of the demultiplexer circuit according to the embodiments of the present disclosure. First, an NMOS transistor is turned on when the gate-source voltage difference (Vgs) is larger than the threshold value, and the conduction degree of the NMOS transistor is related to the gate-source voltage difference (Vgs). Moreover, it should be understood by those skilled in the art that the conduction degree of the NMOS transistor is also related to the channel width-to-length ratio of the NMOS transistor. In other words, the larger the gate-source voltage difference (Vgs), and the larger the channel width-length ratio of the NMOS transistor, the higher the conduction degree of NOMS transistor. In the operation process of the demultiplexer circuit, the magnitude of the gate signal voltage remains unchanged, when each NMOS transistor is controlled to be turned on, and the conduction is realized by configuring the voltage difference between the gate signal voltage and the source signal voltage to be larger than the threshold value. Meanwhile, the source signal is outputted as the output signal of the demultiplexer circuit. During an actual operation, the source signal generally changes as the timing changes, a positive voltage source signal and a negative voltage source signal are usually provided. In order to make the gate-source voltage difference of the NMOS transistor larger than the threshold value, it is necessary to set the gate signal voltage value reasonably. Apparently, on the basis that the gate signal is the positive voltage source signal and remains unchanged, when the source signal is the negative voltage signal, the gate-source voltage difference Vgs− is larger than the gate-source voltage difference Vgs+ when the source signal is the positive voltage source signal, in other words, when the source signal is the negative voltage signal, the conduction degree of the NMOS transistor is higher. Based on that the conduction degree of the NMOS transistor is not only positively correlated with the gate-source voltage difference (Vgs), but also positively correlated with the channel width-length ratio of the NMOS transistor, when the source signal is the negative voltage source signal, the channel width-length ratio of the NMOS transistor may be appropriately reduced on the premise that the conduction degree of the transistor meets requirements. Thus, in the demultiplexer circuit according to the embodiments of the present disclosure, for each switching transistor group 11, when the source signal provided by the input end 101 is the negative voltage signal, part of the at least two switching transistors 110 in the respective switching transistor group 11 may be turned off through the adjustment of the gate signal input by each control end 103, namely, the gate of each switching transistor 110, so that the channel width-to-length ratio of the switching transistor group 11 is decreased, and the parasitic capacitance in the switching transistor group is thereby reduced. It is to be understood that although the channel width-to-length ratio of the switching transistor group 11 is decreased, the gate-source voltage difference is relatively large when the voltage source is negative, so the conduction degree of the transistor may meet the requirements, the normal switching control and signal transmission of the demultiplexer circuit can be ensured. Meanwhile, since the parasitic capacitance of the switching transistor group 11 is decreased when the source signal is negative, the power consumption of the demultiplexer circuit is reduced to a certain extent. Exemplarily, in the leftmost switching transistor group 11 as shown in FIG. 1, in t1 stage, when the input end 101 inputs a positive voltage signal, the upper and lower switching transistors 110 may be controlled to be turned on simultaneously through the control ends 103, and the negative voltage signal is outputted through the common drain 1120 of the two switching transistors 110. In t2 stage, when the input end 101 inputs a negative voltage signal, the lower switching transistor 110 may be controlled to be turned on, and at this time, the negative voltage signal is outputted through the drain 112 of the lower switching transistor 110. Apparently, since only one switching transistor 110 of the switching transistor group 11 is turned on in the t2 stage, the switching transistor group 11 has a relatively small channel width-to-length ratio and a relatively small parasitic capacitance, therefore, the power consumption is relatively low. In the demultiplexer circuit, array substrate, display panel and device, and driving method according to the embodiments of the present disclosure, the multiple demultiplexers are disposed in the demultiplexer circuit. Each demultiplexer includes at least two switching transistor groups, and each switching transistor group includes at least two switching transistors. The sources of the at least two switching transistors in the same switching transistor group are electrically connected to each other to form a common source. The drains of the at least two switching transistors in the same switching transistor group are electrically connected to each other to form a common drain. Moreover, each switching transistor group includes one input end, one output end and at least two control ends. The input ends of the at least two switching transistor groups in the same demultiplexer are electrically connected to each other. In the same switching transistor group, the common source is electrically connected to the input end, the common drain is electrically connected to the output end, and the at least two control ends are electrically connected to the gates of the at least two switching transistors in a one-to-one correspondence. In this manner, the number of turned on switching transistors in each switching transistor group can be controlled, and the channel width-to-length ratio and parasitic capacitance of each switching transistor group can be changed. The embodiments of the present disclosure can reduce high power consumption caused by the fixed parasitic capacitance of an existing demultiplexer, and on the premise that the transistor conduction degree meets the requirements, the channel width-to-length ratio of each switching transistor group can be changed, so as to adapt to the size of the parasitic capacitance adjusted by driving signals, and facilitate reducing of the power consumption of the demultiplexer circuit. It can be seen from the demultiplexer circuit provided in the preceding embodiments that each switching transistor 110 in each switching transistor group 11 includes a control end 103, when driving control is performed, it is necessary to correspondingly set a control port on the driving chip, resulting in an excessive number of ports of the driving chip. To reduce the number of the control ends 103 and the number of ports of the driving chip in the demultiplexer circuit, the embodiments of the present disclosure further provide another demultiplexer circuit. FIG. 2 is a schematic diagram illustrating a structure of another demultiplexer circuit according to an embodiment of the present disclosure. Referring to FIG. 2, each switching transistor group 11 includes one first switching transistor 1101 and one first control end 1031, and a gate 113 of the first switching transistor 1101 is electrically connected to the first control end 1031. Each demultiplexer 10 has a same number of switching transistor groups 11, and first control ends 1031 of switching transistor groups 11 in different demultiplexers 10 are electrically connected in a one-to-one correspondence. The first control ends 1031 of the switching transistor groups 11 in different demultiplexers 10 are electrically connected in the one-to-one correspondence means that gates 113 of the first switching transistors 1101 of the corresponding switching transistor groups 11 corresponding to the different demultiplexers 10 are electrically connected to each other. As shown in FIG. 2, each demultiplexer 10 includes three switching transistor groups 11, and the three switching transistor groups 11 in one demultiplexer 10 correspond to a respective one of the three switching transistor groups 11 in another demultiplexer 10, where the gates 113 of the first switching transistors 1101 are electrically connected through wiring. At this time, in each demultiplexer 10, gate signals of the first switching transistors 1101 in the corresponding switching transistor group 11 are consistent and synchronized, and the first switching transistors 1101 electrically connected to the gates are turned on or off synchronously. At this point, the demultiplexer circuit may reduce the number of gate signal lines of switching transistors 1101, and these gate signals can be provided by a same control port when the driving chip is set.

Figure 3:
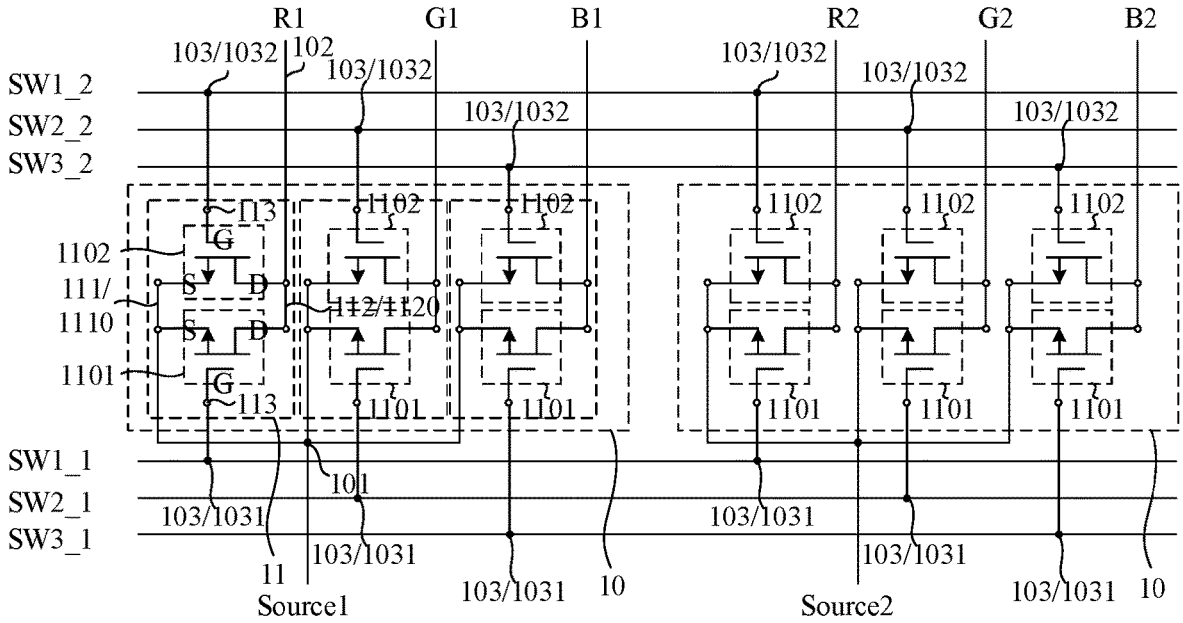
FIG. 3 is a schematic diagram illustrating a structure of still another demultiplexer circuit according to an embodiment of the present disclosure.

FIG. 3 is the schematic diagram illustrating a structure of another demultiplexer circuit according to an embodiment of the present disclosure. Referring to FIG. 3, in an embodiment, each switching transistor group 11 may further include one second switching transistor 1102 and one second control end 1032, a gate 113 of the second switching transistor 1102 is electrically connected to the second control end 1132, and second control ends 1132 of switching transistor groups 11 in different demultiplexers 10 are electrically connected in a one-to-one correspondence.

On the basis of the demultiplexer circuit shown in FIG. 2, the second switching transistor 1102 is further provided in each switching transistor group 11, and the gates 113 of the second switching transistors 1102 in the at least two switching transistor groups 11 corresponding to each demultiplexer 10 are electrically connected, that is, in each demultiplexer 10, gate signals of the second switching transistors 1102 in the at least two corresponding switching transistor groups 11 are consistent and synchronized, and the corresponding second switching transistors 1102 electrically connected to the gates are turned on or off synchronously. At this time, the demultiplexer circuit may further reduce the number of gate signal lines of switching transistors 110, and the gate signals may be provided by a same control port when the driving chip is set. It is to be noted that in the demultiplexer circuit shown in FIG. 3, each switching transistor group 11 includes two switching transistors 110, namely, the first switching transistor 1101 and the second switching transistor 1102, which is only an example, and those skilled in the art can also set each switching transistor group 11 including more switching transistors 110, which is not limited herein.

Figure 4:
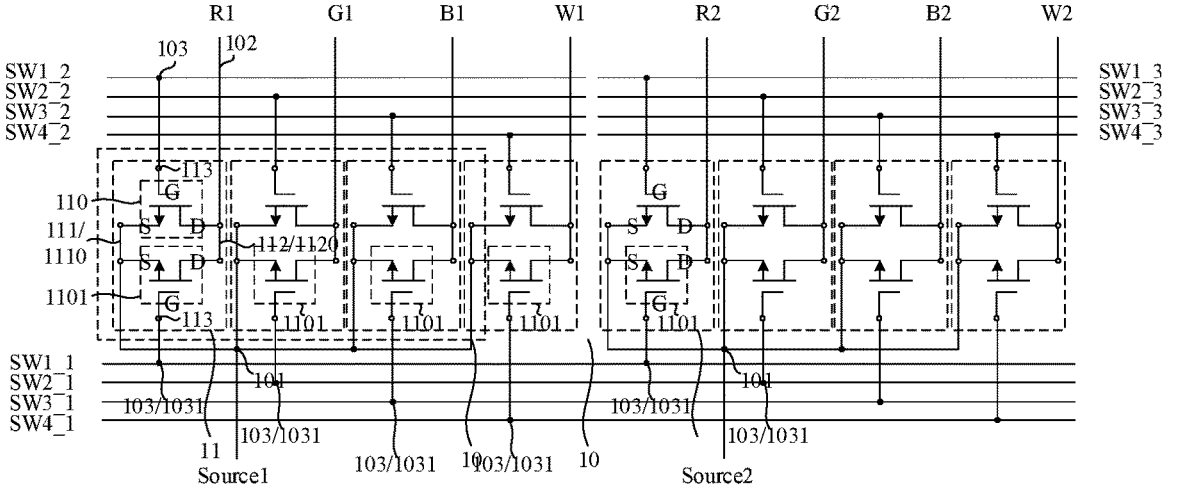
FIG. 4 is a schematic diagram illustrating a structure of still another demultiplexer circuit according to an embodiment of the present disclosure.

Further, in an embodiment, in the demultiplexer circuit provided by the preceding embodiments, at least two switching transistors 110 in each switching transistor group 11 have a same type, and the switching transistors 110 may be N-channel metal oxide semiconductor (NMOS) transistors or P-channel metal oxide semiconductor (PMOS) transistors. For the demultiplexer circuit composed of PMOS transistors, the conduction of a transistor is realized when the gate-source voltage difference (Vgs) of the PMOS transistor is less than the threshold value, that is, the conduction degree of the PMOS transistor is related to the gate-source voltage difference (Vgs). Meanwhile, the conduction degree of the PMOS transistor is also related to the channel width-length ratio of the PMOS transistor. Similarly, when the voltage difference Vgs is used to control the conduction of each switching transistor group 11, part of the at least two switching transistors 110 in each switching transistor group 11 may be selected to be turned on, so that the channel width-to-length ratio of the switching transistor group 11 can be adjusted, the parasitic capacitance can be reduced, thus the power consumption of the demultiplexer circuit can be improved. In the demultiplexer circuit shown in the preceding embodiments, each demultiplexer example includes three switching transistor groups 11, that is, each demultiplexer 10 has one input and three outputs. The demultiplexer circuit is generally applied to a display panel with red subpixel units, green subpixel units and blue subpixel units. Each column of subpixel units is composed of subpixel units of a same color. The three output ends of each demultiplexer are respectively connected to a column of subpixel units, and the demultiplexer provides data signals to the three columns of subpixel units successively. Of course, those skilled in the art can also adjust the output quantity of the demultiplexer according to an actual output demand. In an embodiment, each demultiplexer includes N switching transistor groups 11, where N is an integer greater than or equal to 2. Further, in some application scenarios, it may be set that N=2, 3, 4, or 6. FIG. 4 is a schematic diagram illustrating a structure of another demultiplexer circuit according to an embodiment of the present disclosure. Referring to FIG. 4, exemplarily, in the demultiplexer circuit, each demultiplexer includes 4 switching transistor groups 11. The demultiplexer circuit may be applied to a display panel with red subpixel units, green subpixel units, blue subpixel units and white subpixel units. Each column of subpixel units is composed of subpixel units of a same color. Four output ends of each demultiplexer are respectively connected to a column of subpixel units, and the demultiplexer provides data signals to the four columns of subpixel units successively. In addition, on the basis that each demultiplexer includes three switching transistor groups as shown in FIGS. 1 to 3, those skilled in the art can also double the output quantity of the demultiplexer, for example, it can be set that each demultiplexer includes six switching transistor groups. Of course, those skilled in the art can also only set the demultiplexer as a one-to-two demultiplexer, namely, each demultiplexer includes two switching transistor groups.

Figure 5:
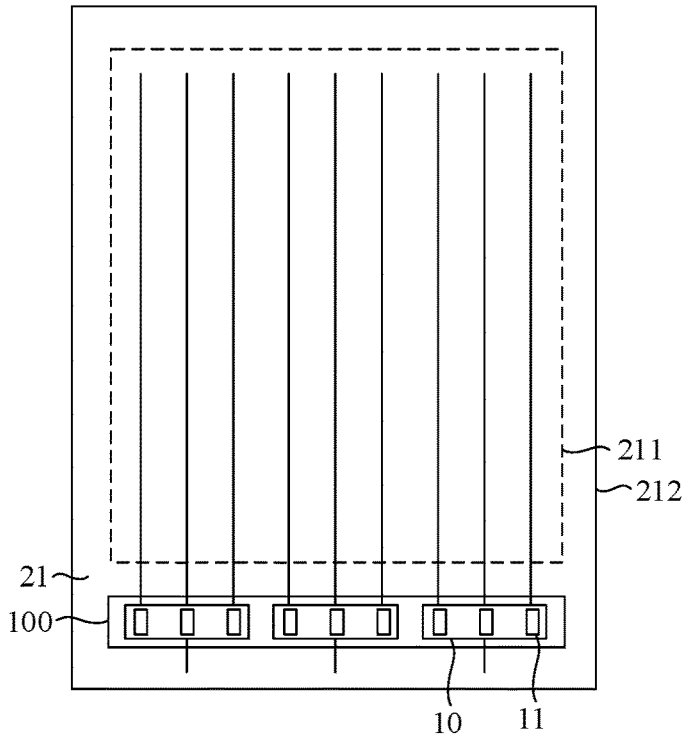
FIG. 5 is a schematic diagram illustrating a structure of an array substrate according to an embodiment of the present disclosure.

Based on the demultiplexer circuit provided by the preceding embodiments, the embodiments of the present disclosure further provide an array substrate. FIG. 5 is a schematic diagram illustrating a structure of an array substrate according to an embodiment of the present disclosure. Referring to FIG. 5, the array substrate includes a substrate 21 and a demultiplexer circuit 100 disposed on the substrate 21, the substrate 21 includes a display region 211 and a non-display region 212 adjacent to the display region 211, and the demultiplexer circuit 100 is located in the non-display region 212.

The display region 211 of the array substrate is provided with multiple scan lines extending along a row direction, multiple data lines extending along a column direction, and multiple pixel driving circuits formed by intersections of the multiple scan lines and the multiple data lines. The multiple pixel driving circuits are electrically connected to the multiple scan lines and the multiple data lines, and scan driving signals are provided by the multiple scan lines and data signals are provided by the multiple data lines, so as to realize lighting of the multiple subpixel units and form an image. The input ends of the demultiplexer circuit 100 located in the non-display region 211 are electrically connected to the driving chip, and the output ends are connected to the multiple data lines in a one-to-one correspondence. A data signal is provided to pixel driving circuits in each column successively by the driving chip, the demultiplexer circuit 100 and the data line.

Figure 6:
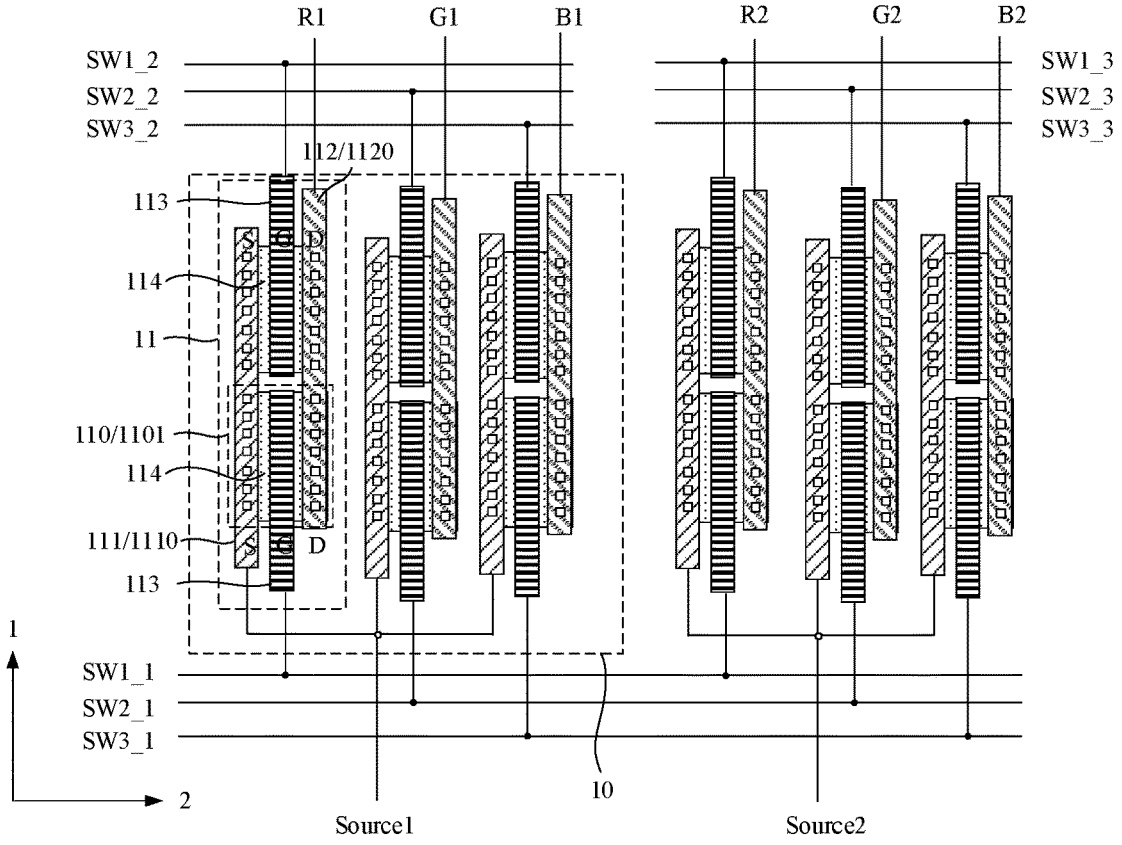
FIG. 6 is an enlarged view of the partial array substrate of FIG. 5.

FIG. 6 is an enlarged view of the partial array substrate shown in FIG. 5. Referring to FIG. 6, in an embodiment, in a same switching transistor group 11 of the array substrate, active regions 114 of the at least two switching transistors 110 are arranged along a first direction 1, and sources 111, drains 112 and gates 113 of each switching transistor 110 all extend along the first direction 1. The sources 111 of the at least two switching transistors 110 extend along the first direction 1 and are connected to each other to form the common source 1110. The drains 112 of the at least two switching transistors 110 extend along the first direction 1 and are connected to each other to form the common drain 1120.

In the array substrate shown in FIG. 6, each whole switching transistor group 11 extends along the first direction 1, and different switching transistor groups 11 are sequentially arranged along a second direction 2, where the sources 111 in a same switching transistor group 11 are directly connected to each other, and the drains 112 in the same switching transistor group 11 are directly connected to each other, so that the distance between the at least two switching transistors 110 in a same switching transistor group 11 can be reduced, and a regular layout of the demultiplexer circuit can be ensured, which benefits for making the wiring of the array substrate convenient and reducing the area of the non-display region of the array substrate to a certain extent. Of course, those skilled in the art may also design the layout of the demultiplexer circuit on the array substrate more reasonably based on the purpose of decreasing the occupied area and distance length of each switching transistor group in the demultiplexer circuit, and reducing the number of wirings or lowering the difficulty of the manufacture process, which is not limited herein.

It is to be noted that the layout structure in the array substrate shown in FIG. 6 corresponds to the demultiplexer circuit shown in FIG. 2, where the first switching transistor 1101 is provided in each switching transistor group 11, the gates 113 of the first switching transistors 1101 of switching transistor groups 11 corresponding to different demultiplexers 10 are electrically connected to each other, and these first switching transistors 1101 connected to the gate control signal lines may be synchronously controlled through one gate control signal line, for example SW1_1. Thus, the number of gate control signal lines can be spared, which helps to reduce the control ports of the driving chip. Of course, those skilled in the art can reasonably set the layout structure of the demultiplexer circuit as shown in FIG. 1 or FIG. 3 according to the array substrate structure shown in FIG. 6. The details will not be repeated here.

Figure 7:
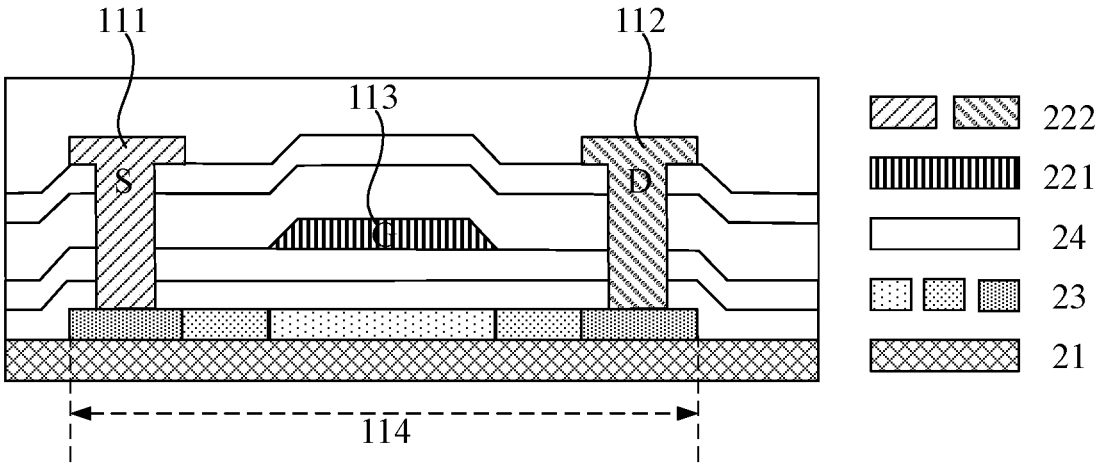
FIG. 7 is a cross-sectional view illustrating a structure of a thin film transistor in a demultiplexer circuit on the array substrate of FIG. 6.

FIG. 7 is a cross-sectional view of the sectional structure of a thin film transistor in the demultiplexer circuit on the array substrate shown in FIG. 6. Referring to FIG. 7, the array substrate further includes a first conductive layer 221, a semiconductor layer 23 and a second conductive layer 222 which are disposed on the substrate 21. In the demultiplexer circuit, a gate 113 of each switching transistor is disposed in the first conductive layer 221, a source 111 and a drain 112 of each switching transistor are disposed in the second conductive layer 222, and the first conductive layer 221 and the second conductive layer 222 are different layers. An active region 114 of each switching transistor 110 is disposed in the semiconductor layer 23. Each of vertical projections of the source 111, the drain 112 and the gate 113 on the substrate 21 overlaps a vertical projection of the active region 114 on the substrate 21. The source 111 and the drain 112 are electrically connected to the active region 114 through a via.

In the switching transistor shown in FIG. 6, the source 111 and the drain 112 are electrically connected to the active region 114 of the semiconductor layer, and the rectangular box in the figure shows a structure of the via in which the source 111 and the drain 112 are respectively and electrically connected to the active region 114. The active region 114 of the semiconductor layer is electrically connected to electrodes through a plurality of vias, which can realize the relatively uniform electrical contact of the semiconductor layer with both of the source and the drain, and ensure the effective transmission of electrical signals.

It is to be noted that in the array substrate shown in FIG. 7, the type of each switching transistor is essentially top-gate top-contact thin film transistor. This thin film transistor further includes an insulating layer 24, and in the top-gate top-contact thin film transistor, the film layer structure and the manufacture sequence are in an order of the substrate 21, the semiconductor layer 23, the insulating layer 24, the first conductive layer 221, the insulating layer 24, and the second conductive layer 222.

Figure 8:
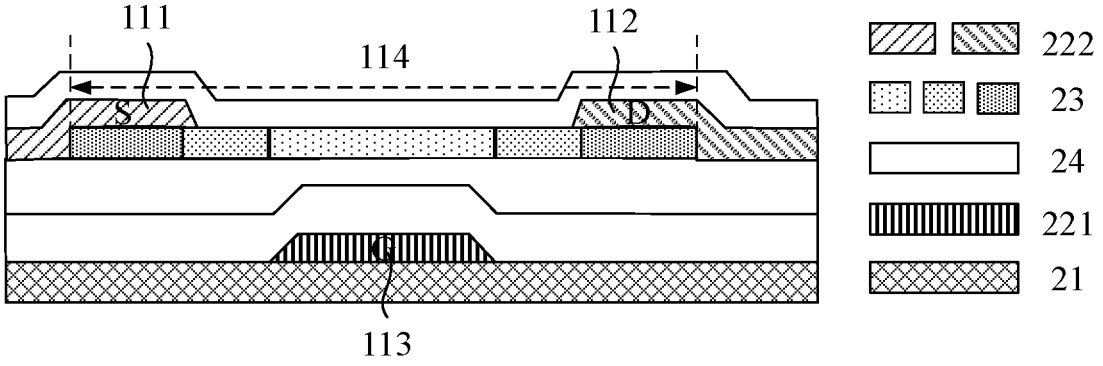
FIG. 8 is a cross-sectional view illustrating a structure of another thin film transistor according to an embodiment of the present disclosure.

FIG. 8 is a cross-sectional view of the sectional structure of another thin film transistor according to an embodiment of the present disclosure. Referring to FIG. 8, in an embodiment, the array substrate includes the first conductive layer 221, the semiconductor layer 23 and the second conductive layer 222 which are disposed on the substrate 21. In the demultiplexer circuit 100, a gate 113 of each switching transistor 110 is disposed in the first conductive layer 221, a source 111 and a drain 112 of each switching transistor 110 are disposed in the second conductive layer 222, and the first conductive layer 221 and the second conductive layer 222 are different layers, an active region 114 of each switching transistor 110 is disposed in the semiconductor layer 23. Each of vertical projections of the source 111, the drain 112 and the gate 113 on the substrate 21 overlaps a vertical projection of the active region 114 on the substrate 21.

The switching transistors 110 of the demultiplexer circuit 100 in the array substrate are bottom-gate top-contact thin film transistors, and this film structure and manufacture sequence are in an order of the substrate 21, the first conductive layer 221, the insulating layer 24, the semiconductor layer 23 and the second conductive layer 222.

Additionally, in the array substrate according to the embodiments of the present disclosure, the switching transistors 110 in the demultiplexer circuit 100 may further be configured as bottom-gate bottom-contact transistors and top-gate bottom-contact thin film transistors. Those skilled in the art may design and manufacture according to an actual process equipment, which will not be described in detail herein.

Figure 9:
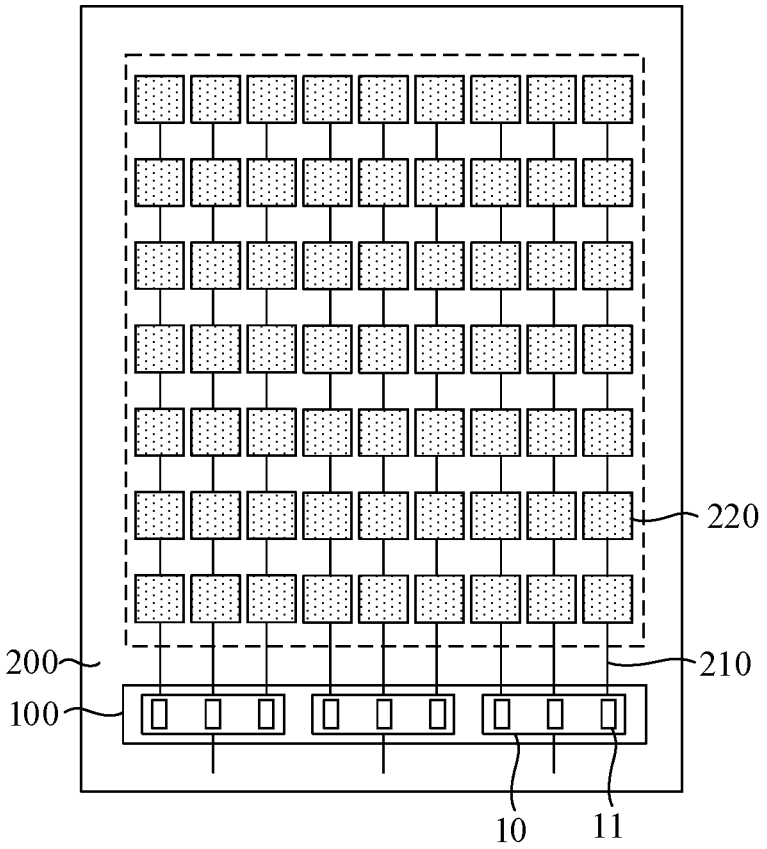
FIG. 9 is a schematic diagram illustrating a structure of a display panel according to an embodiment of the present disclosure.

The embodiments of the present disclosure further provide a display panel and a driving method of the display panel. FIG. 9 is a schematic diagram illustrating a structure of a display panel according to an embodiment of the present disclosure. Referring to FIG. 9, the display panel includes the array substrate 200 provided by the preceding embodiments, and further includes multiple data lines 210 and multiple subpixel units 220 arranged in an array. In the demultiplexer circuit 100 on the array substrate 200, each switching transistor group in each demultiplexer 10 is correspondingly connected to a respective one of the multiple data lines 210, and each of the multiple data lines 210 is connected to a plurality of subpixel units 220 in a same column.

Figure 10:
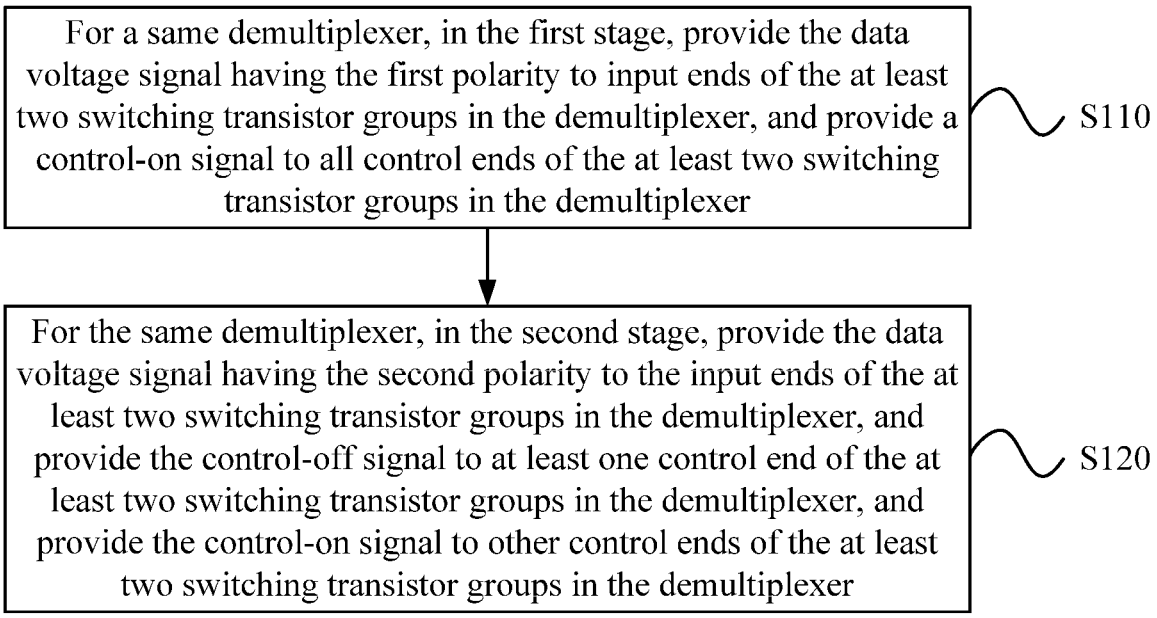
FIG. 10 is a flowchart of a driving method of a display panel according to an embodiment of the present disclosure.
Figure 11A:
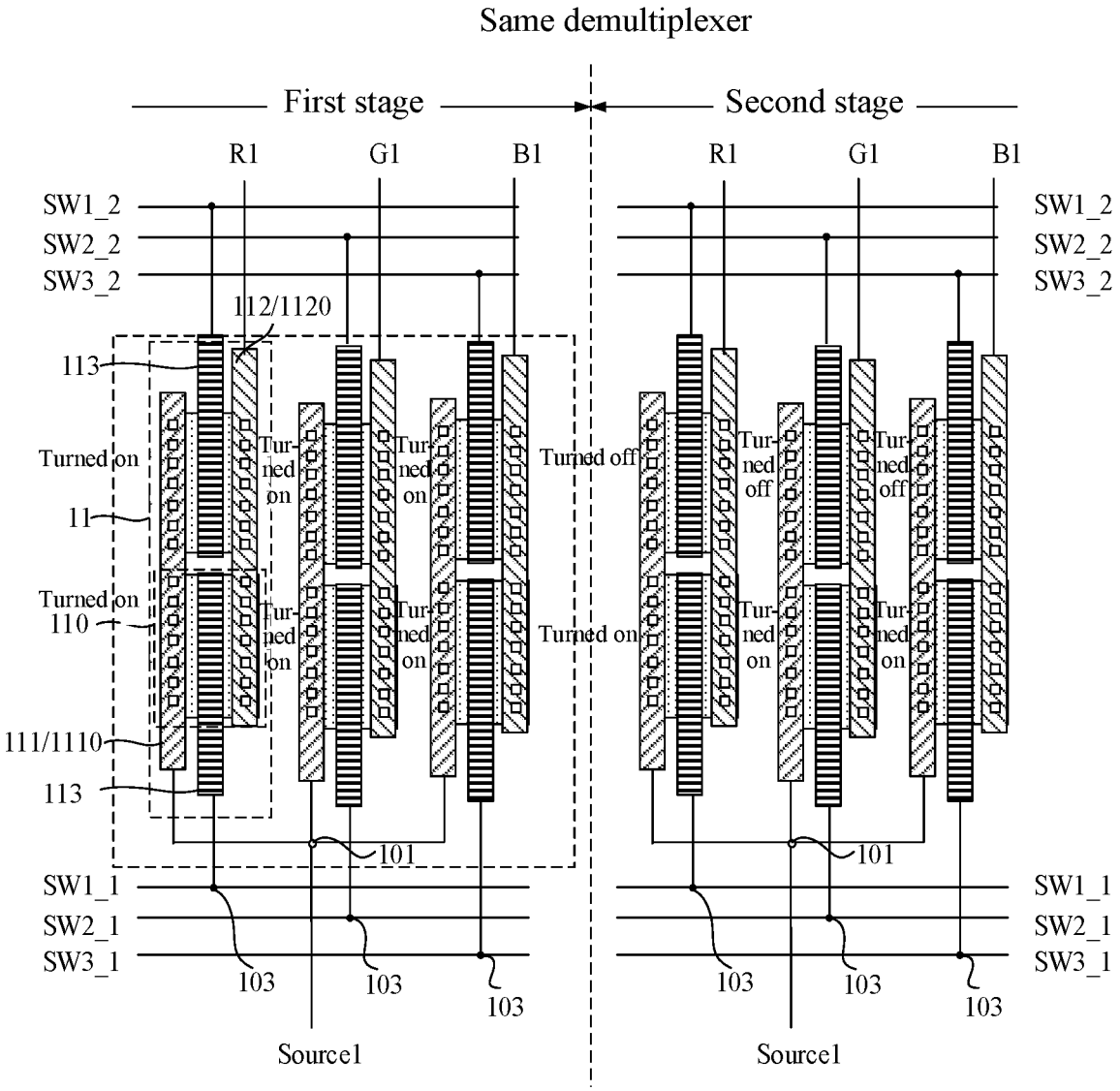
FIG. 11*a* is a schematic diagram illustrating statuses of the display panel of FIG. 10 at different stages.

On the basis of the preceding display panel, the embodiments of the present disclosure provide the driving method of the display panel. FIG. 10 is a flowchart of a driving method of a display panel according to an embodiment of the present disclosure, and FIG. 11*a* is a schematic diagram illustrating statuses of the display panel of FIG. 10 at different stages. Referring to FIGS. 9, 10 and 11*a*/11*b*, the driving method includes steps described below.

In S110, for a same demultiplexer, in the first stage, a data voltage signal having a first polarity is provided to input ends of the at least two switching transistor groups in the demultiplexer, and a control-on signal is provided to all control ends of the at least two switching transistor groups in the demultiplexer.

Figure 11B:
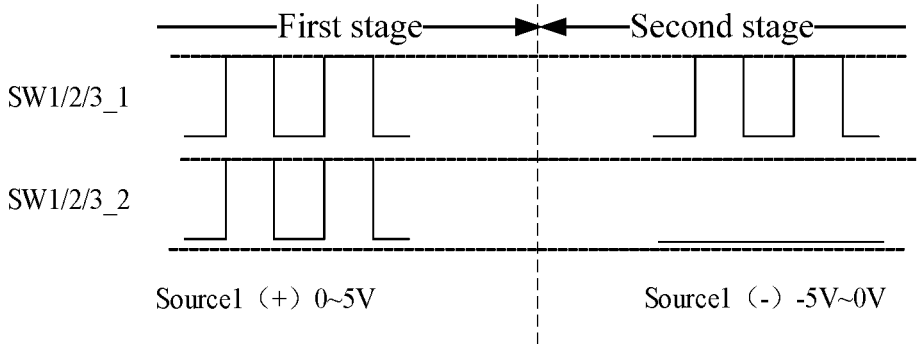
FIG. 11*b* is a schematic diagram illustrating statuses of data voltage signals at different stages corresponding to FIG. 11*a*.

The data voltage signal is essentially a signal provided by the driving chip to the input ends 101 of the at least two switching transistor groups 11 in the demultiplexer, that is, a signal provided by the sources 111 of the switching transistors 110. The data voltage signal is input to the multiple data lines 210 of the display panel through the demultiplexer circuit 100, and the data voltage signal is further provided to subpixel units 220 in a column through the corresponding data line 210 to drive the subpixel units 220 to be lighted up. In an actual driving control process of the panel, the driving chip provides positive and negative data voltage signals in stages respectively. As a result, the data voltage signal having the first polarity may be a data voltage signal having a positive voltage or a negative voltage. As shown in FIG. 11*b*, exemplarily, in the first stage, the data voltage signal having the first polarity Source 1 is a positive voltage signal of 0-5 V. In this stage, the control-on signal is provided to all control ends 103 of the at least two switching transistor groups 11, which is essentially to control all switching transistors 110 in the at least two switching transistor groups 11 to be turned on. At this time, the channel width-to-length ratio of the switching transistor group 11 is the sum of the channel width-to-length ratios of all switching transistors 110 in the switching transistor group 11. The parasitic capacitance of the switching transistor group 11 is equal to the sum of the parasitic capacitance of all the switching transistors 110.

S120, for the same demultiplexer, in the second stage, a data voltage signal having a second polarity is provided to the input ends of the at least two switching transistor groups in the demultiplexer, a control-off signal is provided to at least one control end of the at least two switching transistor groups in the demultiplexer, and the control-on signal is provided to the other control ends of the at least two switching transistor groups in the demultiplexer. The polarity of the data voltage signal having the first polarity is opposite to a polarity of the data voltage signal having the second polarity. The voltage difference between the data voltage signal having the first polarity and the control-on signal is smaller than the voltage difference between the data voltage signal having the second polarity and the control-on signal. In this stage, the data voltage signal having the second polarity is provided to the input ends 101 of the at least two switching transistor groups 11, that is, the sources 11 of the switching transistors 110, which in fact provides a data voltage signal having an opposite polarity to subpixel units 220 in a corresponding column. Since the potential of the control-on signal inputted by the gate 113 of the switching transistor 110 is fixed, the gate-source voltage difference (Vgs) formed by the data voltage signal and the control-on signal is different. If the voltage difference between the data voltage signal having the first polarity and the control-on signal is smaller than the voltage difference between the data voltage signal having the second polarity and the control-on signal, it is indicated that the gate-source voltage difference (Vgs) of the switching transistor 110 is relatively large in the second stage, and therefore, the conduction degree of the corresponding switching transistor 110 is relatively high. Generally, the control-on signal is a positive voltage signal, as shown in FIG. 11*b*, in the second stage, the data voltage signal having the second polarity Source2 is a negative voltage signal of −5 to 0 V. Therefore, the gate-source voltage difference of the switching transistor 110 is relatively large in the second stage.

According to the explanation of the principle of reducing power consumption of the demultiplexer circuit, the conduction degree of the switching transistor 110 is related to both of the gate-source voltage difference (Vgs) and the channel width-to-length ratio of the switching transistor 110. On the basis of a relatively large gate-source voltage difference (Vgs) of the switching transistor in the second stage, the channel width-to-length ratio of the switching transistor may be appropriately reduced, and the conduction degree of the switching transistor may meet the requirements of the conduction. The control-off signal is provided to at least one control end 103 of the at least two switching transistor groups 11 and the control-on signal is provided to the other control ends 103 of the at least two switching transistor groups 11 in the demultiplexer, that is, at least one switching transistor 110 may be ensured to be turned on and the other switching transistors 110 to be turned off. At this time, the channel width-to-length ratio of the switching transistor group 11 is equal to the sum of the channel width-to-length ratio of the at least one turned-on switching transistor 110, and the parasitic capacitance is equal to the sum of the parasitic capacitance of the at least one turned-on switching transistor 110, thus eliminating the parasitic capacitance of the turned-off switching transistors 110 and reducing the power consumption of the demultiplexer circuit in the second stage.

It is to be noted that in the first stage and the second stage, the data voltage signal having the first polarity and the data voltage signal having the second polarity which have opposite polarities are provided to data lines R1/G1/B1 through the demultiplexers in the demultiplexer circuit. The purpose is to prevent liquid crystal molecules in the liquid crystal display panel from being tilted and fixed by a fixed data voltage signal for a long time, so as to avoid the afterimage phenomenon. The data voltage signal having the first polarity and the data voltage signal having the second polarity which have opposite polarities are provided alternately by the demultiplexers, which can make the voltage applied to the liquid crystal layer alternating, and ensure the normal rotation of liquid crystal molecules and the display effect.

Figure 12:
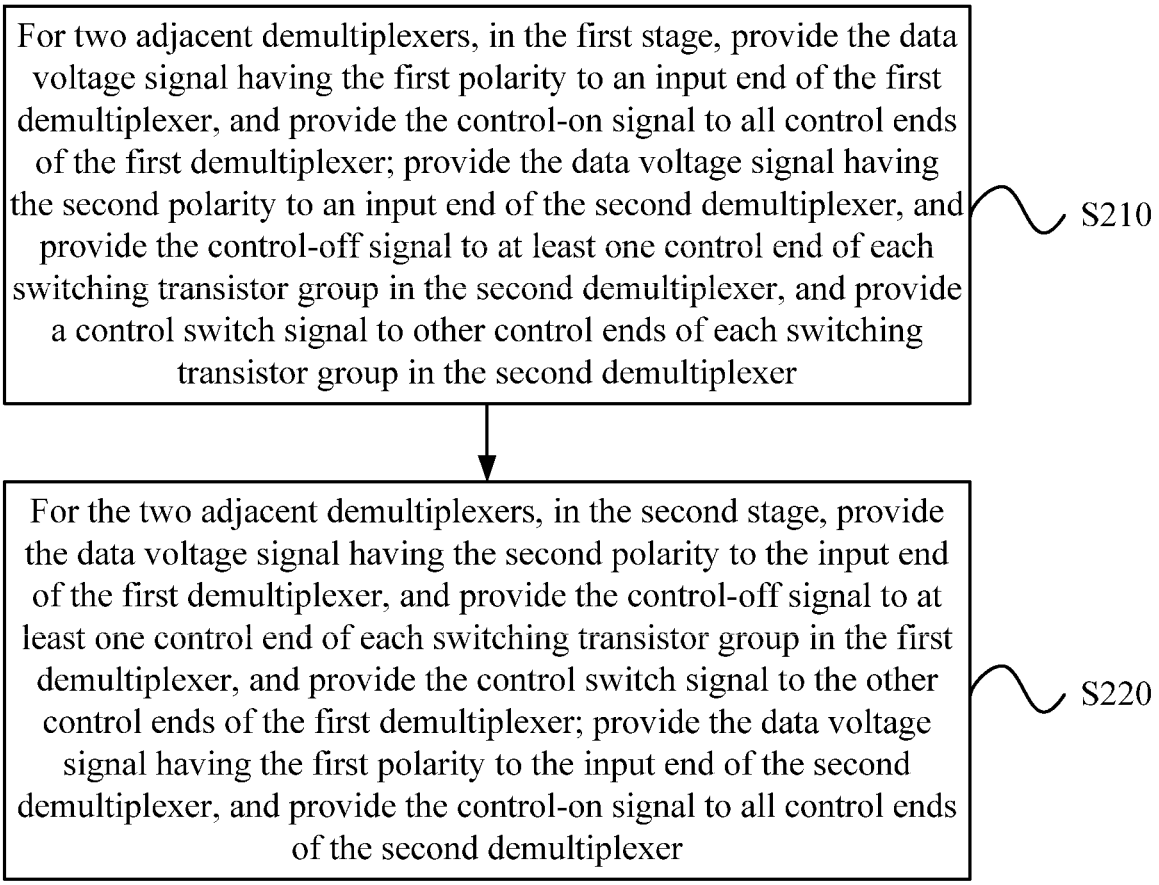
FIG. 12 is a flowchart of a driving method of a display panel according to an embodiment of the present disclosure.
Figure 13A:
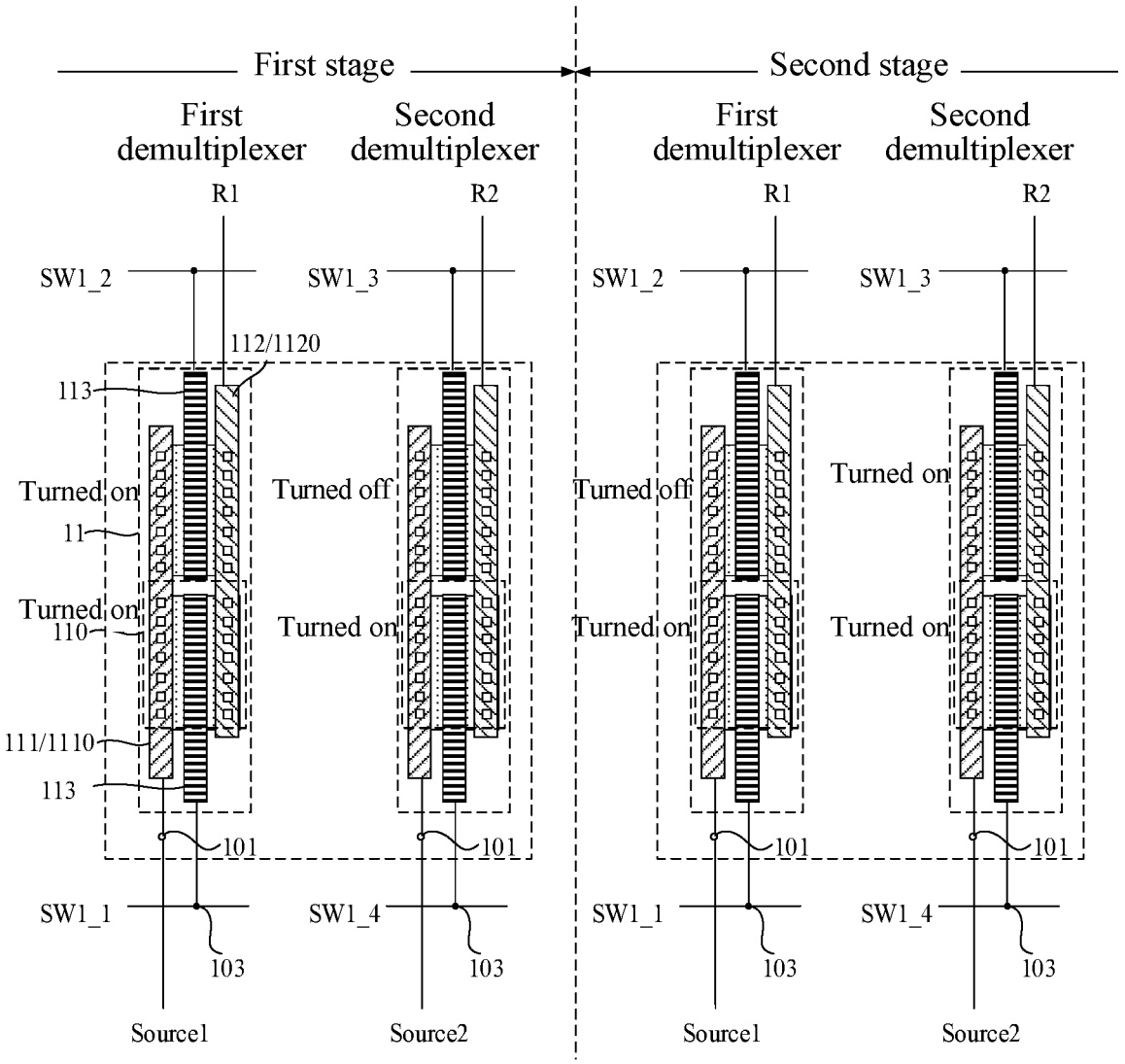
FIG. 13*a* is a schematic diagram illustrating statuses of the display panel of FIG. 12 at different stages.
Figure 13B:
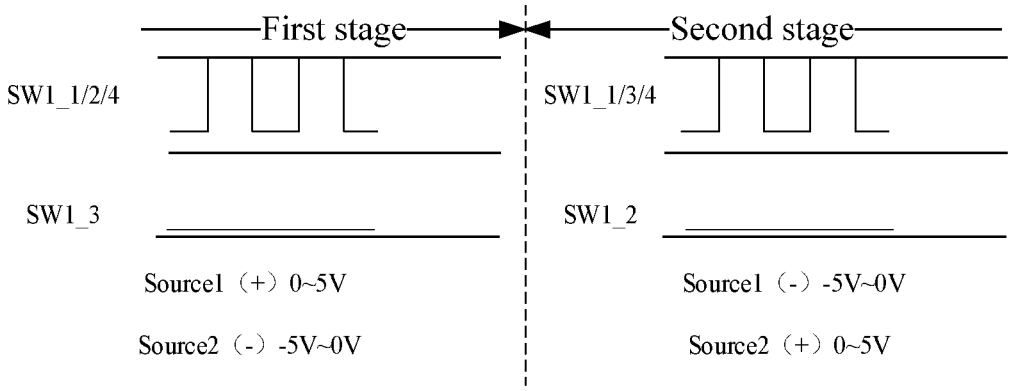
FIG. 13*b* is a schematic diagram illustrating statuses of data voltage signals at different stages corresponding to FIG. 13*a*.

Furthermore, on the basis of the preceding driving method of the display panel, two adjacent demultiplexers in the display panel according to the embodiments of the present disclosure may be configured to include a first demultiplexer and a second demultiplexer. For two adjacent demultiplexers, the embodiments of the present disclosure further provide a driving method of the display panel. FIG. 12 is a flowchart of a driving method of the display panel according to an embodiment of the present disclosure, and FIG. 13*a* is a schematic diagram illustrating statuses of the display panel of FIG. 12 at different stages. Referring to FIGS. 12, 13*a* and 13*b*, the driving method includes steps described below.

In S210, for the two adjacent demultiplexers, in the first stage, the data voltage signal having the first polarity is provided to an input end of the first demultiplexer, and the control-on signal is provided to all control ends of the first demultiplexer. The data voltage signal having the second polarity is provided to an input end of the second demultiplexer, and the control-off signal is provided to at least one control end of each switching transistor group in the second demultiplexer, and the control-on signal is provided to the other control ends of the second demultiplexer.

Similarly, in this stage, since all control ends 103 of the first demultiplexer are provided with the control-on signal, that is, all switching transistors 110 of the first demultiplexer are turned on, the channel width-to-length ratio of each switching transistor group 11 in the demultiplexer 10 is the sum of the channel width-to-length ratios of the at least two switching transistors 110 in the switching transistor group, and at this time, the parasitic capacitance of the switching transistor group 11 is also the sum of the parasitic capacitance of the at least two switching transistors 110. In the second demultiplexer adjacent to the first demultiplexer, the control-off signal is provided to at least one control end 103 of each switching transistor group 11, and the control-on signal is provided to the other control ends 103 of the second demultiplexer, which indicates that only part of the at least two switching transistors 110 are turned on and the other part of the at least two switching transistors 110 are turned off. At this time, for the second demultiplexer, the effective channel width-to-length ratio of the switching transistor group 11 is the sum of the channel width-to-length ratios of the turned-on switching transistors 110, and the parasitic capacitance is also the sum of the parasitic capacitance of the turned-on switching transistors 110. Compared with the first demultiplexer, the parasitic capacitance in the second demultiplexer is smaller and the power consumption is effectively reduced.

S220, for the two adjacent demultiplexers, in the second stage, the data voltage signal having the second polarity is provided to the input end of the first demultiplexer, and the control-off signal is provided to at least one control end of each switching transistor group in the first demultiplexer, and the control-on signal is provided to other control ends of the first demultiplexer. The data voltage signal having the first polarity is provided to the input end of the second demultiplexer, and the control-on signal is provided to all control ends of the second demultiplexer.

It is contrary to the first stage, in this stage, only part of the at least two switching transistors 110 in each switching transistor group 11 of the first demultiplexer are turned on, and some of the switching transistors 110 are turned off. All switching transistors 110 in each switching transistor group 11 of the second demultiplexer are turned on. Apparently, in this stage, compared with the second demultiplexer, the parasitic capacitance in the first demultiplexer is smaller and the power consumption is effectively reduced.

In addition, it is to be understood by those skilled in the art that subpixel units in each column need to alternately transform the polarity of the data voltage according to the time sequence, so as to prevent the tilt fixation of the liquid crystal molecules and avoid the afterimage phenomenon. Based on this, in a same stage, the data voltage signal having the first polarity and the data voltage signal having the second polarity which have opposite polarities are provided to the input end of the first demultiplexer and the input end of the second demultiplexer respectively, which essentially provides positive and negative data signals to data lines corresponding to the two adjacent demultiplexers, and in the display panel, the data voltage signals of any two adjacent columns of subpixel units have opposite polarities, which can ensure that each frame of the display image is relatively uniform. Compared with simultaneously providing data signals having a same polarity in a same stage, and subpixel units in each column still alternately change the polarity of the data voltage in a chronological order, the flicker phenomenon of the display screen is serious and the display effect is poor.

Figure 14A:
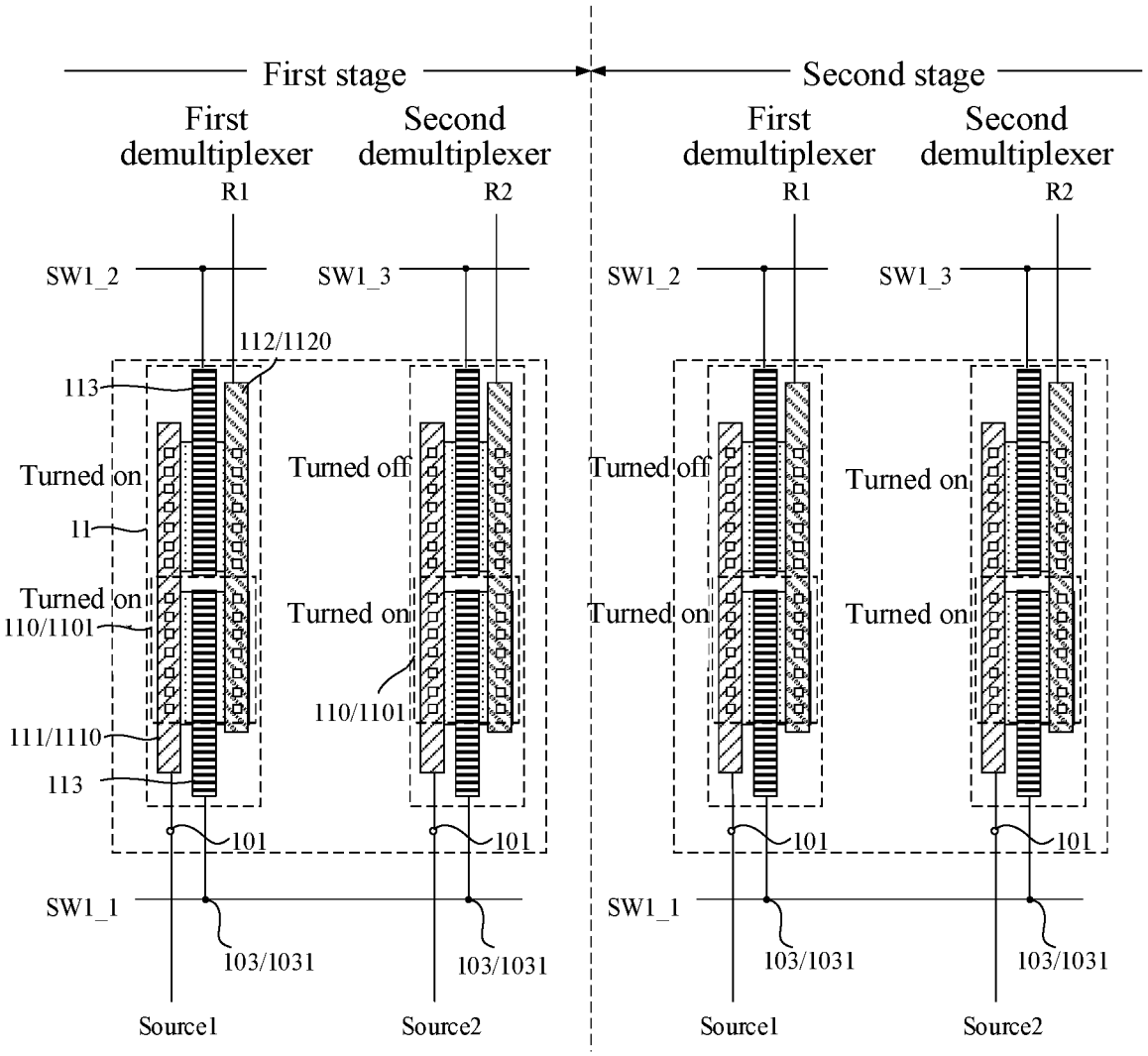
FIG. 14*a* is a schematic diagram illustrating statuses of another driving method of a display panel at different stages according to an embodiment of the present disclosure.
Figure 14B:
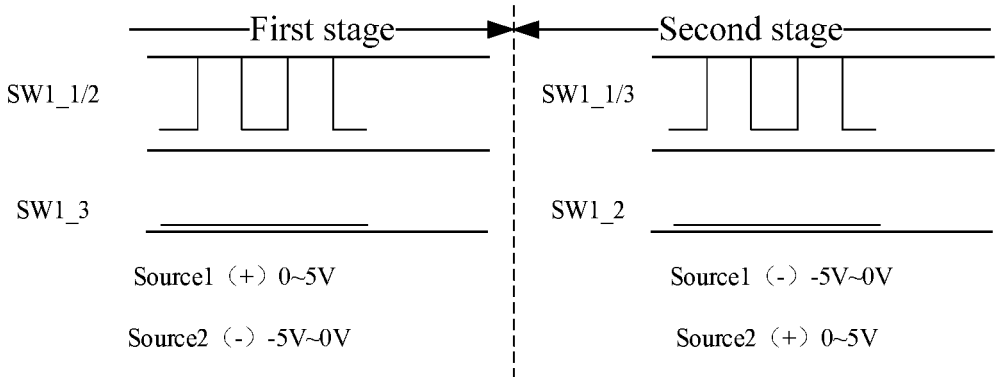
FIG. 14*b* is a schematic diagram illustrating statuses of data voltage signals at different stages corresponding to FIG. 14*a*.

In the preceding display panel shown in FIG. 12, gates of switching transistors are insulated from each other. In other words, switching transistors in each switching transistor group are individually controlled. For the demultiplexer circuit shown in FIG. 2, each switching transistor group 11 includes the first switching transistor 1101 and the first control end 1031, and the gate 113 of the first switching transistor 1101 is electrically connected to the first control end 1031. Each demultiplexer 10 has a same number of switching transistor groups 11, and first control ends 1031 of switching transistor groups 11 in different demultiplexers 10 are electrically connected in a one-to-one correspondence. For the display panel including the demultiplexer circuit shown in FIG. 2, the embodiments of the present disclosure further provide a corresponding driving method. FIG. 14*a* is a schematic diagram illustrating statuses of the display panel at different stages according to an embodiment of the present disclosure. Referring to FIGS. 2, 12, 13*a*, 13*b*, 14*a*, and 14*b*, based on the driving method shown in FIG. 12, the step S130 of the driving method in which the data voltage signal having the second polarity is provided to the input end of the second demultiplexer, the control-off signal is provided to at least one control end of each switching transistor group in the second demultiplexer, and the control-on signal is provided to the other control ends of the second demultiplexer includes steps described below.

The data voltage signal having the second polarity is provided to the input end of the second demultiplexer, and the control-on signal is provided to the first control end of each switching transistor group in the second demultiplexer, and the control-off signal is provided to the other control ends of the second demultiplexer. Step S140 of the driving method in which the data voltage signal having the second polarity is provided to the input end of the first demultiplexer, and the control-off signal is provided to the at least one control end of each switching transistor group in the first demultiplexer, and the control-on signal is provided to the other control ends of the first demultiplexer includes steps described below.

The data voltage signal having the second polarity is provided to the input end 101 of the first demultiplexer, and the control-on signal is provided to the first control end 1031 of each switching transistor group 11 in the first demultiplexer, and the control-off signal is provided to the other control ends of the first demultiplexer.

Figure 15:
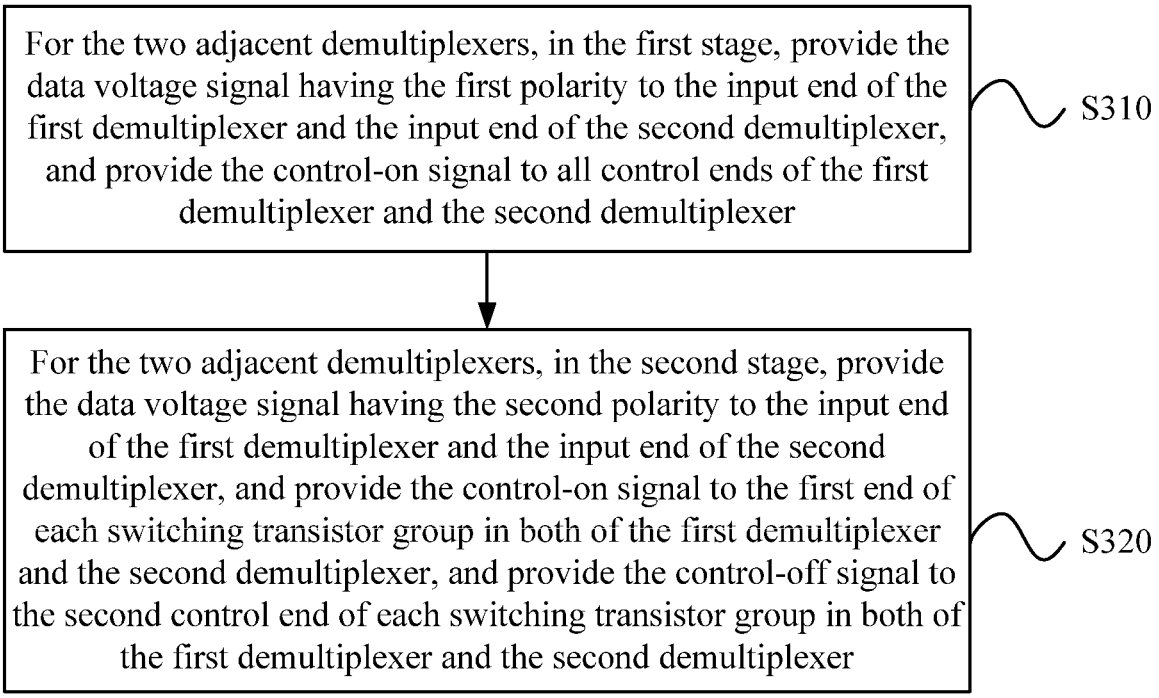
FIG. 15 is a flowchart of still another driving method according to an embodiment of the present disclosure.
Figure 16A:
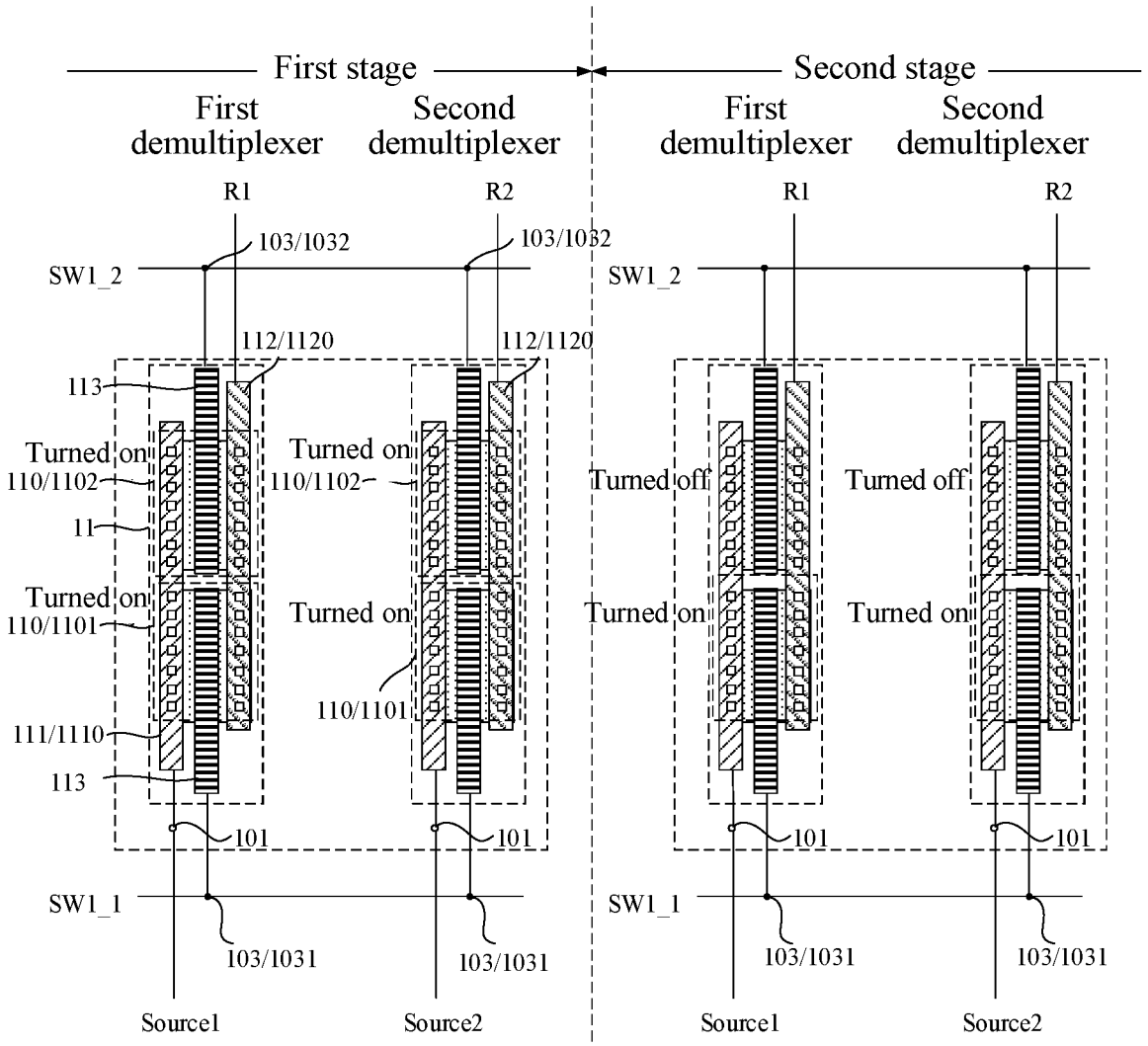
FIG. 16*a* is a schematic diagram illustrating statuses of the display panel of FIG. 15 at different stages.
Figure 16B:
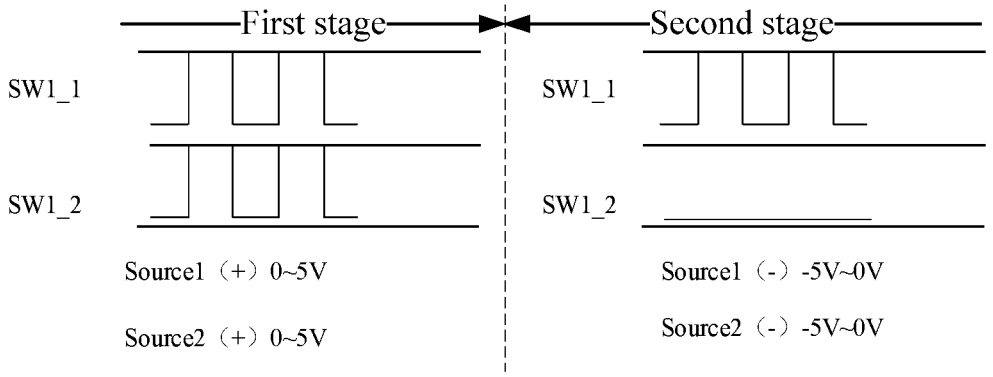
FIG. 16*b* is a schematic diagram illustrating statuses of data voltage signals at different stages corresponding to FIG. 16*a*.

For the display panel including the demultiplexer circuit as shown in FIG. 3, the embodiments of the present disclosure further provide a corresponding driving method. FIG. 15 is a flowchart of another driving method according to an embodiment of the present disclosure, and FIG. 16*a* is a schematic diagram illustrating statuses of the display panel of FIG. 15 at different stages. Referring to FIGS. 3, 15, 16*a* and 16*b*, firstly, in the demultiplexer circuit, each switching transistor group 11 includes the first switching transistor 1101 and the first control end 1031, and the gate 113 of the first switching transistor 1101 is electrically connected to the first control end 1031. Each demultiplexer 10 has a same number of switching transistor groups 11, and first control ends 1031 of switching transistor groups 11 in different demultiplexers 10 are electrically connected in a one-to-one correspondence. Each switching transistor group 11 further includes one second switching transistor 1102 and one second control end 1032, and a gate 113 of the second switching transistor 1102 is electrically connected to the second control end 1032. Second control ends 1032 of switching transistor groups 11 in different demultiplexers 10 are electrically connected in a one-to-one correspondence. Two adjacent demultiplexers include the first demultiplexer and the second demultiplexer. The driving method includes steps described below.

In S310, for the two adjacent demultiplexers, in the first stage, the data voltage signal having the first polarity is provided to the input end of the first demultiplexer and the input end of the second demultiplexer, and the control-on signal is provided to all control ends of the first demultiplexer and the second demultiplexer.

S320, for the two adjacent demultiplexers, in the second stage, the data voltage signal having the second polarity is provided to the input end of the first demultiplexer and the input end of the second demultiplexer, and the control-on signal is provided to the first end of each switching transistor group in both of the first demultiplexer and the second demultiplexer, and the control-off signal is provided to the second control end of each switching transistor group in both of the first demultiplexer and the second demultiplexer.

Figure 17:
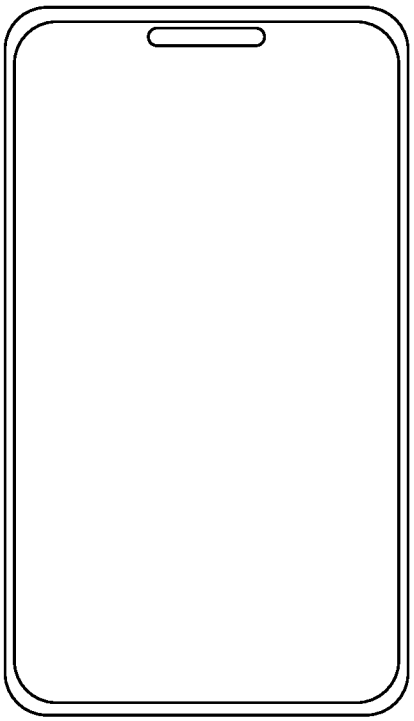
FIG. 17 is a schematic diagram illustrating a display device according to an embodiment of the present disclosure.

FIG. 17 is a schematic diagram illustrating a display device according to an embodiment of the present disclosure. Referring to FIG. 17, the display device includes any display panel provided by the embodiments of the present disclosure. The display device may be, for example, a mobile phone, a computer or an intelligent wearable device.

It is to be noted that the preceding are only alternative embodiments of the present disclosure and the technical principles used therein. It is to be understood by those skilled in the art that the present disclosure is not limited to the embodiments described herein. Those skilled in the art can make various apparent modifications, adaptations, combinations and substitutions without departing from the scope of the present disclosure. Therefore, while the present disclosure has been described in detail via the preceding embodiments, the present disclosure is not limited to the preceding embodiments and may include other equivalent embodiments without departing from the concept of the present disclosure. The scope of the present disclosure is determined by the scope of the appended claims.

What is claimed is:

1. A demultiplexer circuit, comprising a plurality of demultiplexers each comprising at least two switching transistor groups, wherein each of the at least two switching transistor groups comprises at least two switching transistors, sources of the at least two switching transistors in a same switching transistor group are electrically connected to each other to form a common source, and drains of the at least two switching transistors in the same switching transistor group are electrically connected to each other to form a common drain;

wherein each of the at least two switching transistor groups comprises one input end, one output end and at least two control ends; wherein the input ends of the at least two switching transistor groups in a same demultiplexer are electrically connected to each other; and wherein in the same switching transistor group, the common source is electrically connected to the input end, the common drain is electrically connected to the output end, and the at least two control ends are electrically connected to gates of the at least two switching transistors in a one-to-one correspondence, wherein a number of turned-on switching transistors in the same switching transistor group is controlled to change a channel width-to-length ratio and a parasitic capacitance of the same switching transistor group.

2. The demultiplexer circuit of claim 1, wherein each of the at least two switching transistor groups comprises one first switching transistor and one first control end; wherein a gate of the first switching transistor is electrically connected to the first control end; and wherein each of the plurality of demultiplexers has a same number of switching transistor groups, and wherein the first control ends of the at least one switching transistor groups in different ones of the plurality of demultiplexers are electrically connected in a one-to-one correspondence.

3. The demultiplexer circuit of claim 2, wherein each of the at least two switching transistor groups further comprises one second switching transistor and one second control end;

wherein a gate of the second switching transistor is electrically connected to the second control end; and wherein second control ends of switching transistor groups in different ones of the plurality of demultiplexers are electrically connected in a one-to-one correspondence.

4. The demultiplexer circuit of claim 1, wherein each of the plurality of demultiplexers comprises N switching transistor groups, and N=2, 3, 4 or 6.

5. The demultiplexer circuit of claim 1, wherein the at least two switching transistors in each of the at least two switching transistor groups have a same type, and each of the at least two switching transistors is either an N-channel metal oxide semiconductor (NMOS) transistor or a P-channel metal oxide semiconductor (PMOS) transistor.

6. An array substrate, comprising a substrate and a demultiplexer circuit disposed on the substrate, wherein the substrate comprises a display region and a non-display region adjacent to the display region, wherein the demultiplexer circuit is located in the non-display region;

wherein the demultiplexer circuit comprises a plurality of demultiplexers, wherein each of the plurality of demultiplexers comprises at least two switching transistor groups, wherein each of the at least two switching transistor groups comprises at least two switching transistors;

wherein sources of the at least two switching transistors in a same switching transistor group are electrically connected to each other to form a common source, and drains of the at least two switching transistors in the same switching transistor group are electrically connected to each other to form a common drain; and wherein each of the at least two switching transistor groups comprises one input end, one output end and at least two control ends; wherein input ends of the at least two switching transistor groups in a same demultiplexer are electrically connected to each other;

wherein in the same switching transistor group, the common source is electrically connected to the input end, the common drain is electrically connected to the output end; and wherein the at least two control ends are electrically connected to gates of the at least two switching transistors in a one-to-one correspondence, wherein a number of turned-on switching transistors in the same switching transistor group is controlled to change a channel width-to-length ratio and a parasitic capacitance of the same switching transistor group.

7. The array substrate of claim 6, further comprising: a first conductive layer, a semiconductor layer, and a second conductive layer, all of which are disposed on the substrate, wherein in the demultiplexer circuit, a gate of each of the at least two switching transistors is disposed in the first conductive layer, a source and a drain of said switching transistor are disposed in the second conductive layer, and wherein the first conductive layer and the second conductive layer are different layers;

wherein an active region of said switching transistor is disposed in the semiconductor layer;

each of perpendicular projections of the source, the drain and the gate on the substrate overlaps a perpendicular projection of the active region on the substrate, and the source and the drain are electrically connected to the active region through a via.

8. The array substrate of claim 7, wherein active regions of the at least two switching transistors in the same switching transistor group are arranged along a first direction, and each of the source, the drain and the gate of each switching transistor extends along the first direction; and wherein the sources of the at least two switching transistors extend along the first direction and are connected to each other to form the common source, and the drains of the at least two switching transistors extend along the first direction and are connected to each other to form the common drain.

9. A display panel, comprising an array substrate, a plurality of data lines, and a plurality of subpixel units arranged in an array, wherein the array substrate comprises a substrate and a demultiplexer circuit disposed on the substrate, wherein the substrate comprises a display region and a non-display region adjacent to the display region, wherein the demultiplexer circuit is located in the non-display region, and wherein the demultiplexer circuit comprises a plurality of demultiplexers;

wherein each of the plurality of demultiplexers comprises at least two switching transistor groups, wherein each of the at least two switching transistor groups comprises at least two switching transistors; wherein sources of the at least two switching transistors in a same switching transistor group are electrically connected to each other to form a common source, and drains of the at least two switching transistors in the same switching transistor group are electrically connected to each other to form a common drain;

wherein each of the at least two switching transistor groups comprises one input end, one output end and at least two control ends, wherein input ends of the at least two switching transistor groups in a same demultiplexer are electrically connected to each other;

wherein in the same switching transistor group, the common source is electrically connected to the input end, the common drain is electrically connected to the output end, and the at least two control ends are electrically connected to gates of the at least two switching transistors in a one-to-one correspondence, wherein a number of turned-on switching transistors in the same switching transistor group is controlled to change a channel width-to-length ratio and a parasitic capacitance of the same switching transistor group; and wherein in the demultiplexer circuit on the array substrate, each switching transistor group in each demultiplexer is connected to a respective one of the plurality of data lines, and wherein each of the plurality of data lines is connected to a plurality of subpixel units in a same column.

10. A method of driving the display panel of claim 9, comprising:

for a same demultiplexer of the plurality of demultiplexers, providing, in a first stage, a data voltage signal having a first polarity to the input ends of the at least two switching transistor groups in the demultiplexer, and providing a control-on signal to all control ends of the at least two switching transistor groups in the demultiplexer;

for the same demultiplexer, providing, in a second stage, a data voltage signal having a second polarity to the input ends of the at least two switching transistor groups in the demultiplexer; and providing a control-off signal to at least one control end of the at least two switching transistor groups in the demultiplexer, and providing the control-on signal to the other control ends of the at least two switching transistor groups in the demultiplexer;

wherein the first polarity is opposite to the second polarity; and wherein a voltage difference between the data voltage signal having the first polarity and the control-on signal is less than a voltage difference between the data voltage signal having the second polarity and the control-on signal.

11. The method of driving the display panel of claim 10, wherein two adjacent demultiplexers of the plurality of demultiplexers comprise a first demultiplexer and a second demultiplexer, wherein the method comprises:

for the two adjacent demultiplexers, in the first stage, providing the data voltage signal having the first polarity to an input end of the first demultiplexer, and providing the control-on signal to all control ends of the first demultiplexer;

providing the data voltage signal having the second polarity to an input end of the second demultiplexer, and providing the control-off signal to at least one control end of each of the at least two switching transistor groups in the second demultiplexer and the control-on signal to other control ends of said switching transistor group in the second demultiplexer; and for the two adjacent demultiplexers, in the second stage, providing the data voltage signal having the second polarity to the input end of the first demultiplexer, and providing the control-off signal to at least one control end of each switching transistor group in the first demultiplexer and the control-on signal to other control ends of each switching transistor group in the first demultiplexer;

providing the data voltage signal having the first polarity to the input end of the second demultiplexer, and providing the control-on signal to all control ends of the second demultiplexer.

12. The method of driving the display panel of claim 11, wherein each of the at least two switching transistor groups in the demultiplexer circuit comprises a first switching transistor and a first control end, and wherein a gate of the first switching transistor is electrically connected to the first control end;

wherein each demultiplexer has a same number of switching transistor groups, wherein the first control ends of switching transistor groups in different demultiplexers are electrically connected in a one-to-one correspondence;

wherein providing the data voltage signal having the second polarity to the input end of the second demultiplexer, and providing the control-off signal to the at least one control end of each of the two switching transistor groups in the second demultiplexer and the control-on signal to the other control ends of said switching transistor group in the second demultiplexer, providing the data voltage signal having the second polarity to the input end of the second demultiplexer, and providing the control-on signal to the first control end of each of the at least two switching transistor groups in the second demultiplexer and the control-off signal to the other control ends of each switching transistor group in the second demultiplexer;

and wherein providing the data voltage signal having the second polarity to the input end of the first demultiplexer, and providing the control-off signal to the at least one control end of each switching transistor group in the first demultiplexer and the control-on signal to the other control ends of each switching transistor group in the first demultiplexer comprise:

providing the data voltage signal having the second polarity to the input end of the first demultiplexer, and providing the control-on signal to the first control end of each switching transistor group in the first demultiplexer and the control-off signal to the other control ends of each switching transistor group in the first demultiplexer.

13. The method of driving the display panel of claim 10, wherein each of the at least two switching transistor groups in the demultiplexer circuit comprises a first switching transistor and a first control end, and wherein a gate of the first switching transistor is electrically connected to the first control end;

wherein each demultiplexer has a same number of switching transistor groups, and wherein first control ends of switching transistor groups in different demultiplexers are electrically connected in a one-to-one correspondence;

wherein each said switching transistor group further comprises a second switching transistor and a second control end, wherein a gate of the second switching transistor is electrically connected to the second control end, and second control ends of switching transistor groups in different demultiplexers are electrically connected in a one-to-one correspondence; and wherein two adjacent demultiplexers comprise a first demultiplexer and a second demultiplexer; and wherein the driving method comprises:

for the two adjacent demultiplexers, in the first stage, providing the data voltage signal having the first polarity to an input end of the first demultiplexer and an input end of the second demultiplexer, and providing the control-on signal to all control ends of the first demultiplexer and the second demultiplexer; and for the two adjacent demultiplexers, in the second stage, providing the data voltage signal having the second polarity to the input end of the first demultiplexer and the input end of the second demultiplexer, and providing the control-on signal to the first control end of each switching transistor group in both of the first demultiplexer and the second demultiplexer and the control-off signal to the second control end of each switching transistor group in both of the first demultiplexer and the second demultiplexer.

14. The method of driving the display panel of claim 10, wherein the at least two switching transistors in each switching transistor group have a same type; and wherein each of the at least two switching transistors is an NMOS transistor, wherein the first polarity is positive and the second polarity is negative; or, each switching transistor is a PMOS transistor, wherein the first polarity is negative and the second polarity is positive.

15. A display device, comprising the display panel of claim 9.

* * * * *